US010974883B1

(12) United States Patent
Questiaux

(10) Patent No.: US 10,974,883 B1
(45) Date of Patent: Apr. 13, 2021

(54) LATCHING HOLDER FOR STORING A PLURALITY OF FASTENERS

(71) Applicant: Kenneth Ralph Questiaux, Butler, PA (US)

(72) Inventor: Kenneth Ralph Questiaux, Butler, PA (US)

( * ) Notice: Subject to any disclaimer, the term of this patent is extended or adjusted under 35 U.S.C. 154(b) by 164 days.

(21) Appl. No.: 16/501,319

(22) Filed: Mar. 25, 2019

(51) Int. Cl.
*B65D 73/00* (2006.01)
*B25H 3/04* (2006.01)

(52) U.S. Cl.
CPC ..... *B65D 73/0042* (2013.01); *B25H 3/04* (2013.01); *B65D 73/0085* (2013.01)

(58) Field of Classification Search
CPC ..... B65D 73/005; B65D 73/0042; B65D 73/0085; B65D 73/0078; B65D 73/0071; B65D 73/0064; B65D 73/0035; B65D 73/00; B65D 73/0021; B25H 3/003; B25H 3/04
USPC ..... 206/472, 486, 495, 348, 63.3, 338, 1.5
See application file for complete search history.

(56) References Cited

U.S. PATENT DOCUMENTS 1,474,113 A * 11/1923 Harris ..... B65D 73/0021 206/338
1,691,781 A * 11/1928 Meyer ..... B65D 5/5002 206/760
2,030,996 A * 2/1936 Lustig ..... G09F 5/042 206/466
4,784,270 A * 11/1988 Layer ..... B65D 81/054 206/320
4,826,059 A 5/1989 Bosch et al.
5,326,577 A * 7/1994 Warnock ..... B65D 71/10 426/124
5,373,939 A * 12/1994 Bloomgren ..... A47F 7/0028 206/341
7,150,362 B1 * 12/2006 Questiaux ..... B25H 3/04 211/70.6
7,537,125 B2 5/2009 Plouchart
8,118,162 B1 * 2/2012 McEwin ..... B25H 3/04 206/338

* cited by examiner

*Primary Examiner* — Steven A. Reynolds
(74) *Attorney, Agent, or Firm* — Aileen Champion Addessi

(57) ABSTRACT

A latching holder for storing a plurality of fasteners includes a support member having a first panel, a second panel, a longitudinal slit and a longitudinal portion therebetween for enabling the first and second panels to fold toward one another. One of the first and second panels of the support member has a plurality of holes having a central aperture and wavy slots extending radially outwardly therefrom. The other of the first and second panels contacts the fasteners in a folded position for retaining the fasteners within the latching holder. Each of the first and second panels has an integrally formed latch for securing the first and second panels together to provide additional retainment of the plurality of fasteners within the latching holder. The integration of the latches and the panels with the holder provides a one piece holder without adding additional components for securely storing the plurality of fasteners.

15 Claims, 5 Drawing Sheets

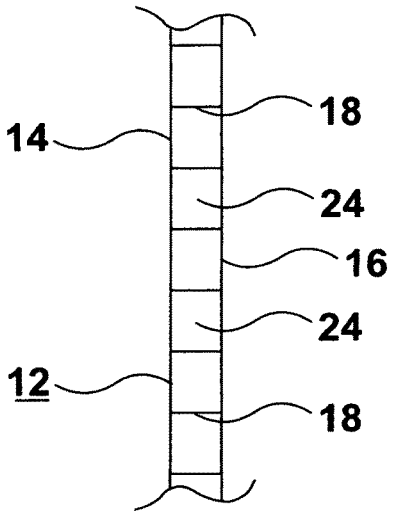
FIG. 2
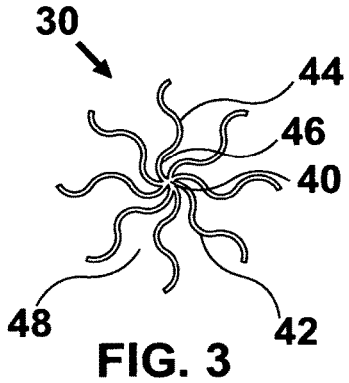
FIG. 3
FIG. 4
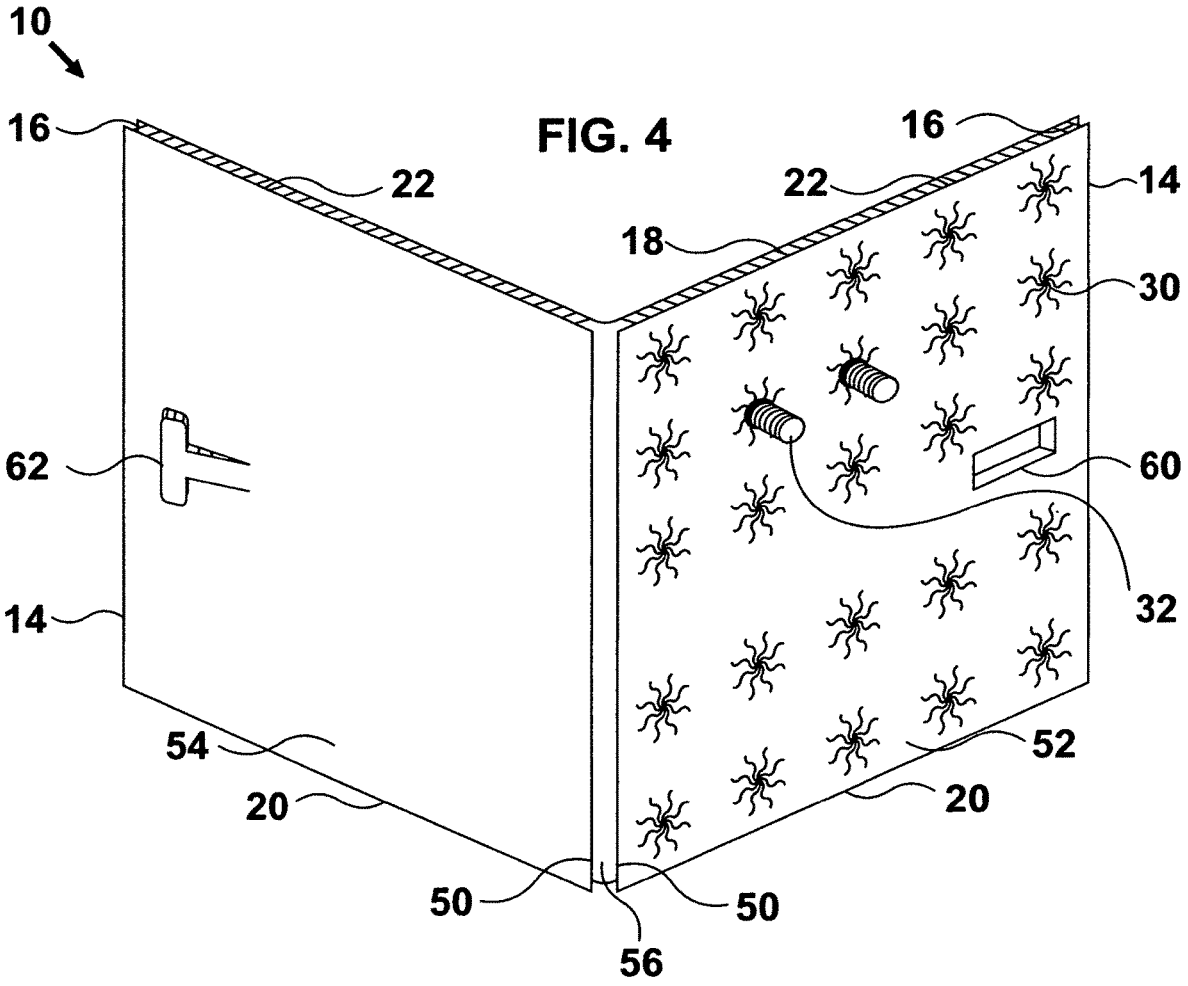

LATCHING HOLDER FOR STORING A PLURALITY OF FASTENERS

BACKGROUND OF THE INVENTION

The invention relates to storage devices and, more particularly, to a holder for supporting and holding various sizes and types of fasteners that has a latching feature for securing the fasteners in position.

When an aircraft, automobile, or other piece of equipment is disassembled for repair or maintenance, the fasteners, such as the bolts, screws, nuts, washers, or the like, are placed in a container. This bin type of storage stores the plurality of fasteners in a loose, bulk fashion without separation of the individual elements. For this type of storage method, the fasteners are not labeled and when an individual has to reassemble the parts of the aircraft, automobile, or other piece of equipment, it is difficult and time consuming to find the fastener that fits into the appropriate component. Additionally, for this type of storage method the fasteners are loose and not contained in a secure manner.

U.S. Pat. No. 7,150,362 to Questiaux et al. discloses a holder for storing a plurality of fasteners. The holder utilizes a plurality of holes having wavy slots extending radially outward from a central aperture for forming starburst shaped holes for retaining the fasteners.

In certain situations, it may be desirable to have an additional means for securing the fasteners to the holder. For example, in aviation, FOD or foreign object debris is any article or substance, alien to an aircraft or system, which could potentially cause damage.

Therefore, what is needed is an apparatus for storing fasteners that includes a plurality of holes for positively retaining the fasteners and that includes an additional feature for securing the fasteners to the holder.

SUMMARY OF THE INVENTION

A latching holder for storing a plurality of fasteners includes a support member formed of a flexible piece of material and having a plurality of holes for receiving and retaining the plurality of fasteners. The support member has a first side wall and a second side wall positioned substantially parallel to one another. The support member has a plurality of web members positioned between the first and second side walls for positioning the first and second side walls in spaced apart relationship to one another.

The support member has a longitudinal slit positioned between adjacent web members in one of the first and second walls forming a first panel and a second panel integrally attached to one another, and a longitudinal portion positioned substantially parallel to the longitudinal slit and positioned between adjacent web members in the other of the first and second walls. The first and second panels are foldable toward one another along the longitudinal portion and along the longitudinal slit.

A first latch is integrally formed in one of the first and second panels, and a second latch is integrally formed in the other of the first and second panels. The second latch is engagable with the first latch when the first and second panels are folded together for latching the first and second latches together for providing additional securement for the plurality of fasteners.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

FIG. 2 is a partial side elevational view of the latching holder showing a plurality of web members and channels;

FIG. 3 is a plan view of one of the holes of the latching holder;

FIG. 4 is another perspective view of the holder in an unfolded position;

DESCRIPTION OF THE PREFERRED EMBODIMENT

The invention described herein provides an apparatus for holding fasteners that can be used to easily and quickly store and retain the fasteners in a convenient transportable holder for securely holding the fasteners within a one piece apparatus.

Figure 1:
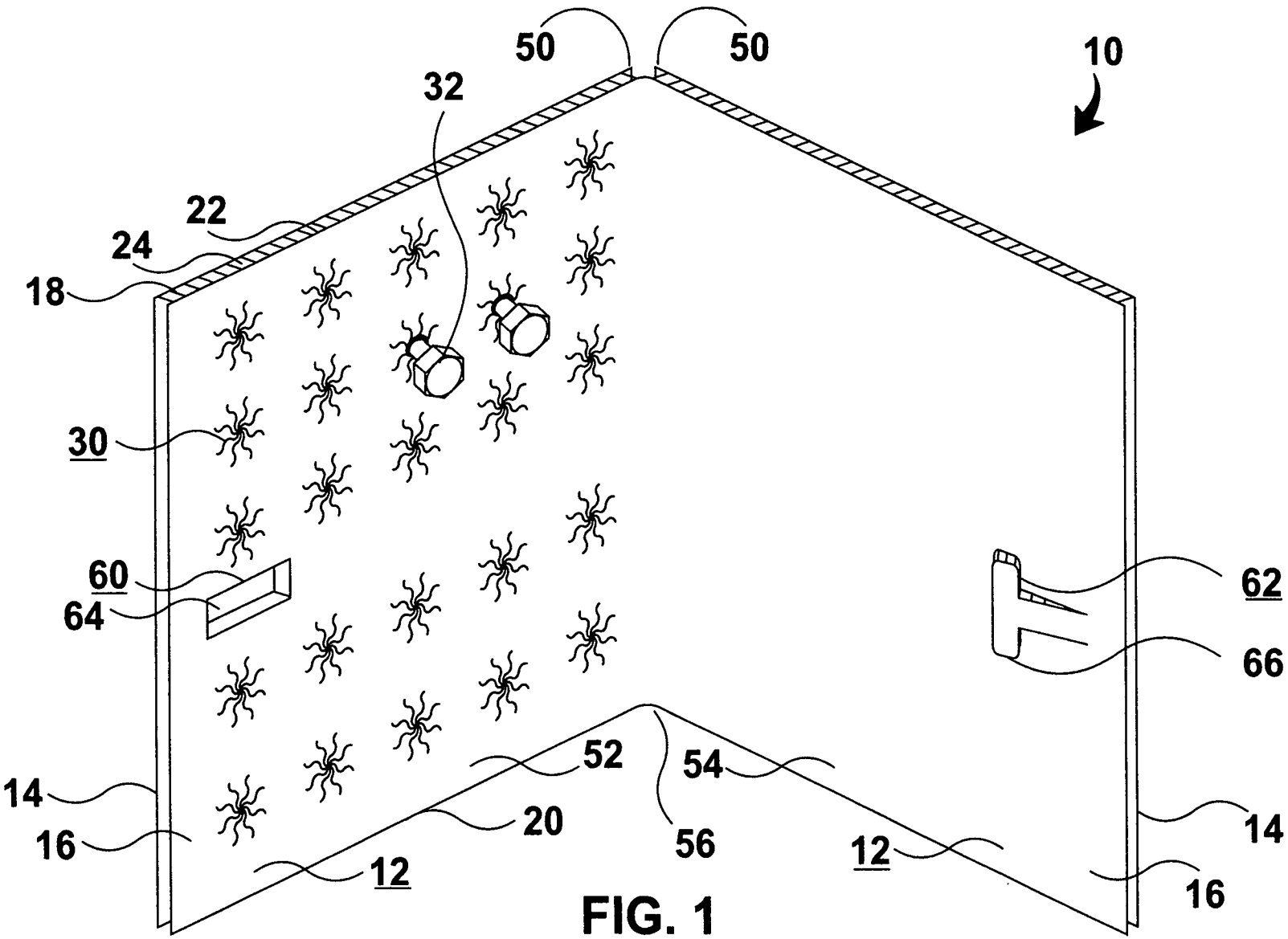
FIG. 1 is a perspective view of a latching holder for storing fasteners.
Figure 5:
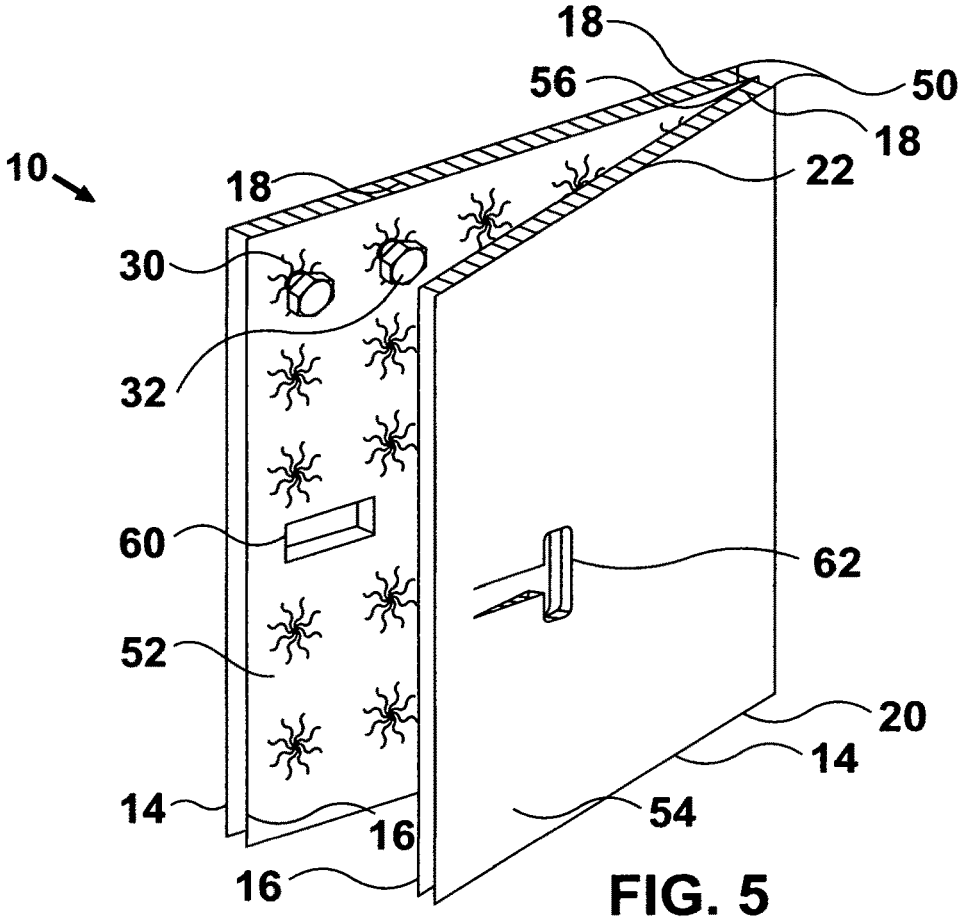
FIG. 5 is a perspective view of the holder in a folded position.
Figure 6:
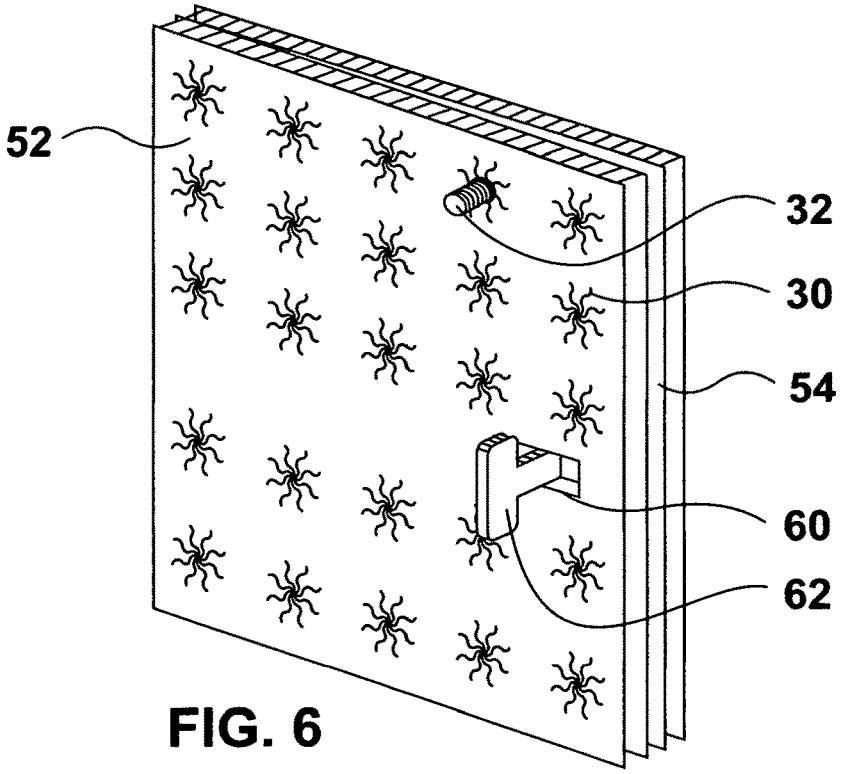
FIG. 6 is a yet another perspective view of the holder having a clasp disposed through an aperture while in a folded position.
Figure 7:
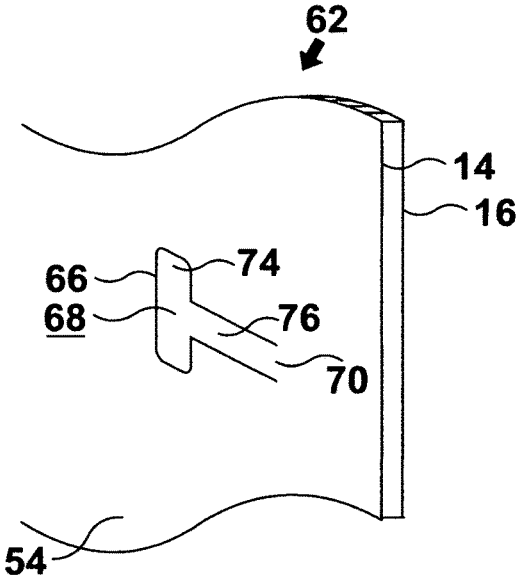
FIG. 7 is a partial perspective view of the clasp positioned within a panel.
Figure 8:
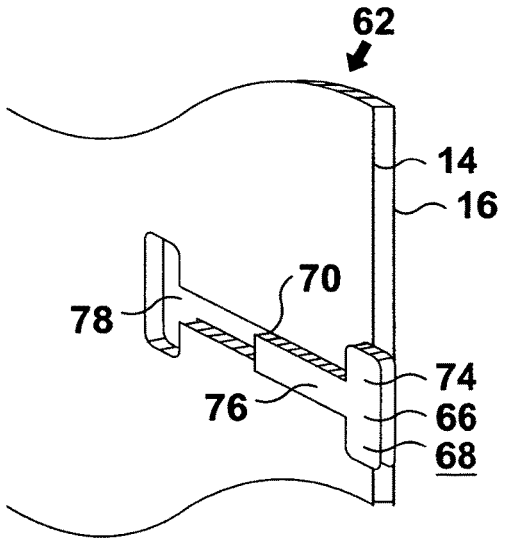
FIG. 8 is a partial perspective view of the clasp having a movable portion folded outward, while remaining integrally attached to the panel.
Figure 9:
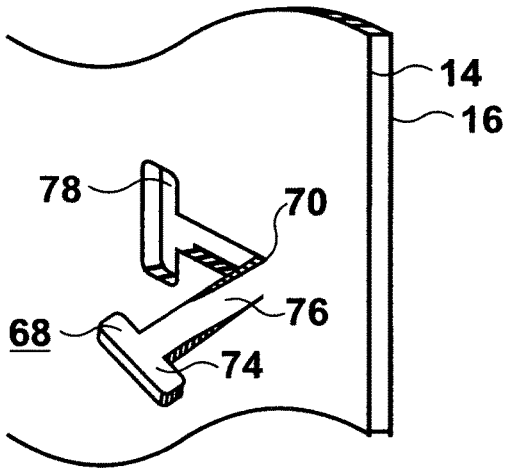
FIG. 9 is yet another partial perspective view of the clasp in a twisted position.
Figure 10:
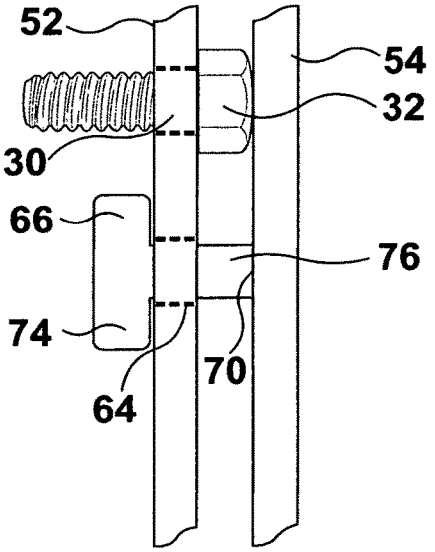
FIG. 10 is a partial side elevational view of the panels, aperture, and clasp in a latched position.

Referring to FIG. 1, a latching holder 10 for storing a plurality of fasteners includes a support member 12, such as a board or piece of material having a rectangular, square, triangular, or other suitable shape. The support member 12 has a first side wall 14 and a second side wall 16 positioned substantially parallel and in spaced apart relation to one another.

Referring to FIGS. 1-2, a plurality of web members 18 are positioned between and attached to the first side wall 14 and the second side wall 16 of the support member 12 for maintaining the spaced apart relationship of the side walls 14 and 16. The web members 18 extend from a first edge 20 to a second edge 22 of the support member 12 and are positioned substantially parallel to one another. The web members 18 form channels 24 between adjacent web members 18.

The support member 12 may be formed from a flexible type of material, such as plastic cardboard marketed under the tradename Coraplast, or any other suitable type of material. The flexible material can be folded, bent, twisted, or the like. Also, preferably, the support member 12 is formed of a material that can withstand moisture or is coated with a material that can withstand moisture. Also, the type of material enables a person to draw with an erasable writing instrument, such as a dry erase marker or other type of washable marker on the support member 12, and later have the markings removed for re-use of the same holder for another task. The person may mark the holder 10 with identification information, such as the name of the aircraft, the required type of work to be done, etc. The fasteners may also be labeled for ease of identification at a later time.

The support member 12 has a plurality of holes 30 disposed therethrough. The holes 30 are sized for accepting various types and sized of fasteners 32, such as bolts, screws, elongated pieces, or the like. The holes 30 are positioned in spaced apart relationship to one another and may be positioned in rows of similar sized holes, may be positioned randomly throughout the support member 12, or may be positioned in any desired pattern. Preferably, similar sized holes 30 are positioned in rows adjacent to one another for grouping similar types of fasteners together.

Referring to FIGS. 1 and 3, each hole 30 has a central aperture 40 and a plurality of wavy slots 42 extending radially outward from the central aperture 40 for forming a starburst shaped hole. Each wavy or curvilinear slot 42 has a shape which resembles a wavelength or wave form having at least one peak or crest 44 and at least one valley or trough 46. Smaller holes 30 have fewer crests 44 and troughs 46 for accepting smaller sized fasteners 32. Larger holes 30 have a greater number of crests 44 and troughs 46 for accepting larger sized fasteners 32. Positioned between adjacent wavy slots 42 are support member segments 48. These support member segments 48 are flexible for enabling the segments 48 to bend during insertion and removal of the fasteners from the support member 12. The shape of the slots 42 provides strength to the support member 12 and enables the support member 12 to be repeatedly used, while still maintaining a secure positioning of the fasteners 32 within the support member 12.

Referring to FIGS. 1 and 4-6, the latching holder 10 has a longitudinal slit 50 cut through the first side wall 14 of the holder 10, and extending from the first edge 20 to the second edge 22. The longitudinal slit 50 is positioned substantially parallel to and between adjacent web members 18. The longitudinal slit 50 separates and forms a first panel 52 and a second panel 54 of the support member 12 of the latching holder 10. Separation of the first side wall 14 into two pieces, while retaining the second side wall 16 as a single piece enables the latching holder 10 to be bendable, foldable, or the like. The longitudinal slit 50 creates a first longitudinal slit edge in the first panel 52 and a second longitudinal slit edge in the second panel 54.

A longitudinal portion 56 is positioned substantially parallel to the longitudinal slit 50 and is positioned in the second side wall 16. The longitudinal portion 56 remains integrally attached to the first and second panels 52 and 54, enabling the flexible material of the support member 12 to be foldable. The longitudinal portion 56 is positioned between adjacent web members 18 and extends from the first edge 20 to the second edge 22. The longitudinal portion 56 is positioned between and separates the first and second panels 52 and 54, and functions like a hinge. The shape of the longitudinal portion 56 may be a flat section that is bendable, curved portion, a definitive folded portion, a crease, or the like. Each of the first and second panels 52 and 54 are foldable toward one another and able to contact one another similar to a book.

Preferably, the plurality of fasteners 30 are positioned in one of the first and second panels 52 and 54 for holding the fasteners 32 in one of the first and second panels 52 or 54. As an example, the holes 30 are positioned in the first panel 52. When the first and second panels 52 and 54 are folded together, the second panel 54 contacts a portion of the fastener 32 extending from the first panel 52. Contact of the second panel 54 with the fastener 32 provides additional securement of the fasteners 32 to the holder 10.

Alternatively the longitudinal slit 50 may be cut through the second side wall 16, and the longitudinal portion 56 may be positioned in the first side wall 14 of the holder 10. Also, the holes 30 may be positioned in either of the first and second panels 52 or 54, or both of the first and second panels 52 and 54.

Referring again to FIGS. 1, 4 and 5, and FIGS. 6-10, the latching holder 10 has a latching feature for providing an additional feature for retaining the fasteners 32 in the holder 10. The latching feature includes the first panel 52 having a first latch 60, and the second panel 54 having a second latch 62. The first latch 60 is engagable with the second latch 62 for securing together the first and second panels 52 and 54 of the latching holder 10. By securing the first and second panels 52 and 54 together, the portion of the fasteners 32 positioned between the first and second panels 52 and 54 is clamped between the first and second panels 52 and 54 and is securely held therebetween, reducing the possibility of loose parts.

As an example, the first latch 60 may be an aperture 64 disposed through the first panel 52. The aperture 64 may have a rectangular shape, a square shape, a circular shape, or any suitable shape.

The second latch 62 may be clasp 66 engagable with the aperture 64 of the first latch 60. The clasp 66 has a movable portion 68 cut or disposed through the second panel 54 and insertable through the aperture 64, and an integral portion 70 that remains integrally attached to the second panel 54, thereby providing a latching feature that has no detachable or loose components. As an example, the movable portion 68 may be a first elongated rectangular shaped segment 74, and a second elongated rectangular shaped segment 76 positioned perpendicular to the first elongated rectangular shaped segment 74. The first elongated rectangular shaped segment 74 is insertable through the aperture 64 and the second elongated segment 76 is bendable. Since the movable portion 68 is disposed through the second panel 54 and is formed from the flexible material of the holder 10, the movable portion 68 can be bent, folded, twisted, or the like, while remaining fixedly attached to the second panel 54.

The integral portion 70 is a segment that remains attached to the second panel 54. While the movable portion 68 is bendable, foldable, twistable or the like, the movable portion 68 remains attached to the holder 10 at the integral portion 70. The type of material used to form the holder 10 provides the stability and durability of the latching feature of the holder 10. An opening 78 is disposed through the second panel 54 having the shape of the second latch 62.

Preferably, the elongated segment 76 is of a length for positioning the first and second panels 52 and 54 in spaced apart relationship from one another. The elongated segment 76 enables a portion of the plurality of fasteners 32, such as a head of a bolt, to be positioned and held between the first and second panels 52 and 54 for providing the additional latching feature of the latching holder 10.

The first segment 74 contacts the surface of the first panel 52 and provides the secure engagement of the first and second panels 52 and 54 together. Having the first segment 74 integrally formed with the second panel 54 and contacting the surface of the first panel 52 provides resistance for the outward movement of the first panel 52 from the second panel 54, thereby holding the plurality of fasteners 32 in a secure position.

Alternatively, the first latch 60 may be disposed in the second panel 54 and the second latch 62 may be positioned in the first panel 52, or the like.

As an alternative to the first and second latch 60 and 62, the latching feature may include any type of latch, such as an interlocking clip with a tab receiving aperture and locking tab, any design of mating components, or any other suitable latching feature.

For the various embodiments of this invention, the same reference characters will be used to designate like parts. In addition, like functions and like interactions of the parts among the various embodiments of this invention will not be repeated for each embodiment.

Figure 11:
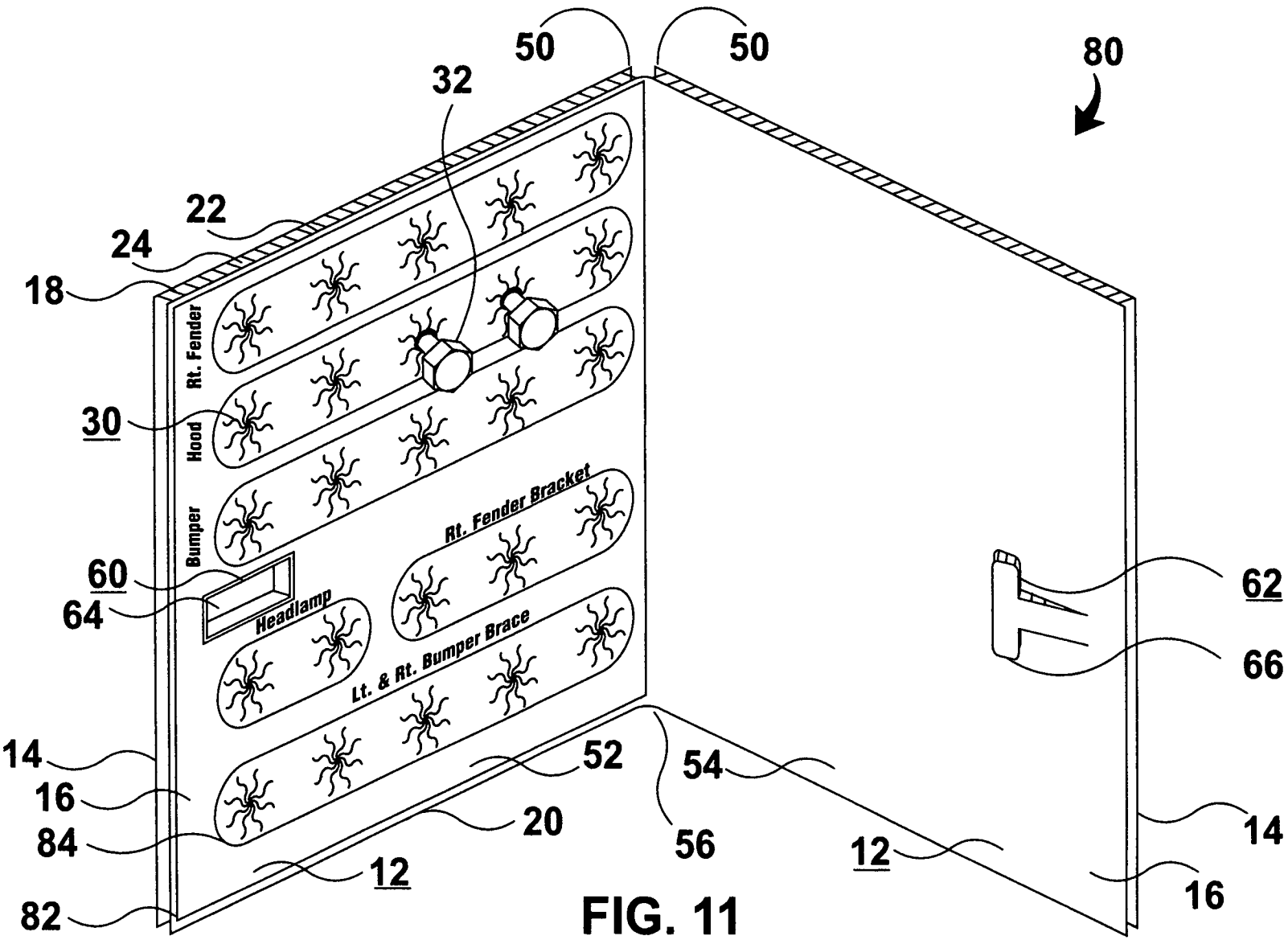
FIG. 11 is an alternative embodiment of the latching holder having a label

Referring to FIG. 11 and using the same reference characters to define like parts, an alternative embodiment of the latching holder 10 as illustrated in FIG. 1 may be a latching holder 80 having like parts as the latching holder 10 and additionally having a label 82 attached to the support member 12. Preferably, the label 82 is positioned on the same wall as the holes 30, such as the second side wall 16. The label 82 provides information to the user of the latching holder 10. The label 82 may be an adhesive sticker, a decal, a single or plurality of labels, may be preprinted on the latching holder 10, or the like. The label 82 may include apertures 84 for disposition of the plurality of fasteners 32.

Additionally, the label 82 may be color coded to identify a specific type or model of vehicle, aircraft, or other piece of equipment. For example, the color of red may indicate a certain brand or type of an automobile, whereas the color of blue would refer to a different brand or type of an automobile. As another example, the label 82 may be color coded to identify specific parts or area of a vehicle, aircraft, or other piece of equipment. For example, the color of yellow may indicate the front section of a helicopter, whereas the color of green may indicate the engine of a helicopter. The label 82 also may include instructions for the user of the latching holder 10 or 80, areas to manually write notes, identification information, or any other desired information.

In operation, the latching holder 10 is selected by an individual, such as an aircraft or automobile mechanic. As the person removes fasteners 32 from the piece of equipment, the bolts, screws, or other items can be inserted into correspondingly sized starburst holes 30. A portion of the fasteners 32 extends from each side of the first and second panels 52 and 54, such as the head of a bolt extending on one side of the second panel 54 and the threaded portion of the bolt extending through an opposite side of the second panel 54. Other fasteners 32, such as nuts, washers, or the like can be secured to the support member 12 either on elongated brackets, wire ties, or other support type features (not shown).

The first and second panels 52 and 54 are foldable toward one another. Having the fasteners 32 positioned in one of the first and second panels 52 or 54, the other of the first and second panels 52 or 54 contacts the fasteners 32 as the panels 52 and 54 are folded or bent toward one another. The first and second latches 60 and 62 are engaged together providing an additional latching or securement feature for the fasteners 32. For example, the movable portion 68 of the clasp 66 can be bent about the integral portion 70, and then twisted. The twisted end of the movable portion 68 can then be inserted through the aperture 64, and untwisted. The movable portion 68 now extends through the aperture 64 in a bent, and untwisted position. The holder 10 can be conveniently placed in the aircraft, automobile, or other storage area while waiting for parts, etc.

An advantage of the holder 10 with the latching feature is that the fasteners 32 can be stored in a more secure position, reducing the likelihood that a fastener 32 would become detached from the holder 10 or loose within an aircraft, automobile, or other piece of equipment.

Another advantage of the holder 10 is that the latching feature is integral with the holder 10 eliminated the possibility of loose components or parts during use of the latching holder 10. By forming the first and second latch 60 and 62 integral with the first and second panels 52 and 54, all of the components of the holder 10 are integrally formed together. All of the components of the latching support holder 10 are designed to be integral with one another, providing a holder 10 that is a single piece of material.

Another advantage of the holder 10 is that various designs of latching features can be employed. The first and second latch 60 and 62 may have various designs of mating components for engaging together the first and second panels 52 and 54 of the holder 10.

An advantage of the holder 10 is that because the holder can be stored in the aircraft, automobile, or other piece of equipment, the holder does not require a separate area of the garage to store each customer's fasteners. The holder 10 can be quickly and easily located when the fasteners 32 are needed.

Yet another advantage of the holder 10 is that because of the unique characteristics of the material of the support member 12 and the design of the starburst holes 30, the holder 10 can be used multiple times without breaking, thereby extending the useful life of the holder 10.

Another advantage of the holder is that the fasteners are stored separately, allowing segregation of different elements relative to each other. The holder eliminates the loose, bulk storage of the fasteners, which creates disorder and confusion, and the possibility of a FOD problem. In any position, the fasteners 32 remain coupled to the support member 12.

There has been shown and described a novel latching holder for storing a plurality of fasteners which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A latching holder for storing a plurality of fasteners, comprising:

a support member formed of a flexible piece of material and having a plurality of holes for receiving and retaining the plurality of fasteners;

the support member having a first side wall and a second side wall positioned substantially parallel to one another, the support member having a plurality of web members positioned between the first and second side walls for positioning the first and second side walls in spaced apart relationship to one another;

the support member having a longitudinal slit positioned between adjacent web members in one of the first and second walls separating a first panel and a second panel from one another;

the support member having a longitudinal portion positioned substantially parallel to the longitudinal slit and positioned between adjacent web members in the other of the first and second walls enabling the first and second panels to fold about the longitudinal portion while remaining integrally attached together;

a first latch integrally formed in one of the first and second panels;

the first latch having an aperture disposed through one of the first panel and second panels;

the aperture of the first latch is an elongated slot;

a second latch integrally formed in the other of the first and second panels and engagable with the first latch when the first and second panels are folded together for latching the first and second latches together for providing additional securement for the plurality of fasteners;

the second latch having a clasp partially disposed through the other of the first and second panels forming a movable portion and an integral portion for enabling the clasp to be manipulated into the aperture while remaining integrally attached to the support holder;

the movable portion of the clasp having a first elongated segment and a second elongated segment, the first elongated segment positioned substantially perpendicular to the second elongated segment, the second elongated segment positioned adjacent to the integral portion of the clasp, the second elongated segment bendable about the integral portion enabling the first elongated segment to be disposed through the aperture for securing the first and second latches together; and the second elongated segment having a length for enabling the first and second panels to be held in spaced apart relationship from one another.

2. The latching holder according to claim 1, further comprising:

the longitudinal slit positioned through the first side wall separating the first side wall into two pieces forming the first panel and second panel; and the longitudinal portion positioned in the second side wall, the second side wall remaining as a single piece of material and bendable about the longitudinal portion providing a hinging feature for the first and second panels of the support holder.

3. The latching holder according to claim 1, further comprising:

the support member having a first edge and a second edge; and the longitudinal slit and the longitudinal portion extend from the first edge to the second edge of the support member.

4. The latching holder according to claim 1, wherein the plurality of holes each further comprise:

a central aperture disposed through the support member; and a plurality of wavy slots extending radially outward from the central aperture for forming a starburst shaped hole for receiving the plurality of fasteners, the starburst shaped hole having a plurality of support member segments positioned between each wavy slot, the plurality of support member segments bendable during disposition and removal of the plurality of fasteners.

5. The latching holder according to claim 1, wherein:

a portion of each of the plurality of fasteners extendable through the first and second side walls of the support member;

the plurality of fasteners positionable in one of the first and second panels; and the other of the first and second panels contactable with the portion of the plurality of fasteners extending through the first and second side walls for securely holding the plurality of fasteners between the folded first and second panels.

6. The latching holder according to claim 1, further comprising at least one label attached to the support member.

7. A latching holder for storing a plurality of fasteners, comprising:

a support member formed of a flexible piece of material and having a plurality of holes for receiving and retaining the plurality of fasteners;

the support member having a first side wall and a second side wall positioned substantially parallel to one another, the support member having a plurality of web members positioned between the first and second side walls for positioning the first and second side walls in spaced apart relationship to one another;

the support member having a longitudinal slit positioned between adjacent web members in one of the first and second walls forming a first panel and a second panel integrally attached to one another;

the support member having a longitudinal portion positioned substantially parallel to the longitudinal slit and positioned between adjacent web members in the other of the first and second walls;

the first and second panels foldable toward one another along the longitudinal slit;

a first latch having an aperture disposed through one of the first and second panels;

the aperture of the first latch is an elongated slot;

a second latch having a movable portion and an integral portion integrally formed in the other of the first and second panels, the movable portion engagable with the aperture when the first and second panels are folded together for latching the first and second latches together in a folded position for providing additional securement for the plurality of fasteners; and the movable portion of the second latch having a first elongated segment and a second elongated segment, the first elongated segment positioned substantially perpendicular to the second elongated segment, the second elongated segment positioned adjacent to the integral portion of the second latch, the second elongated segment twistable about the integral portion enabling the first elongated segment to be disposed through the aperture for securing the first and second latching members together.

8. The latching holder according to claim 7, further comprising:

the longitudinal slit positioned through the first side wall separating the first side wall into two pieces forming the first panel and second panel; and the longitudinal portion positioned in the second side wall, the second side wall remaining as a single piece of material and bendable about the longitudinal slit providing a hinging feature for the support holder.

9. The holder according to claim 7, wherein the plurality of holes each further comprise:

a central aperture disposed through the support member; and a plurality of wavy slots extending radially outward from the central aperture for forming a starburst shaped hole for receiving the plurality of fasteners, the starburst shaped hole having a plurality of support member segments positioned between each curvilinear/wavy slot, the plurality of support member segments bendable during disposition and removal of the plurality of fasteners.

10. The latching holder according to claim 7, wherein:

a portion of each of the plurality of fasteners extendable through the first and second side walls of the support member;

the plurality of fasteners positionable in one of the first and second panels; and the other of the first and second panels contactable with the portion of the plurality of fasteners extending through the first and second side walls for securely holding the plurality of fasteners between the folded first and second panels.

11. The latching holder according to claim 7, further comprising at least one label attached to the support member.

12. A latching holder for storing a plurality of fasteners, comprising:

a support member formed of a flexible piece of material and having a plurality of holes for receiving and retaining the plurality of fasteners;

the plurality of holes each having a central aperture disposed through the support member, and a plurality of wavy slots extending radially outward from the central aperture for forming a starburst shaped hole for receiving the plurality of fasteners, the starburst shaped hole having a plurality of support member segments positioned between each curvilinear/wavy slot, the plurality of support member segments bendable during disposition and removal of the plurality of fasteners;

the support member having a first side wall and a second side wall positioned substantially parallel to one another, the support member having a plurality of web members positioned between the first and second side walls for positioning the first and second side walls in spaced apart relationship to one another;

the support member having a longitudinal slit positioned between adjacent web members in one of the first and second walls forming a first panel and a second panel integrally attached to one another;

the support member having a longitudinal portion positioned substantially parallel to the longitudinal slit and positioned between adjacent web members in the other of the first and second walls;

the first and second panels foldable toward one another along the longitudinal slit;

a first latch integrally formed in one of the first and second panels;

the first latch is an aperture positioned in one of the first panel and second panels;

the aperture is an elongated slot;

a second latch integrally formed in the other of the first and second panels and engagable with the first latch when the first and second panels are folded together for latching the first and second latches together for providing additional securement for the plurality of fasteners;

the second latch is a clasp that is partially disposed through the other of the first and second panels forming a movable portion and an integral portion for enabling the clasp to be manipulated into the aperture while remaining integrally attached to the support member; and the movable portion of the clasp has a first elongated segment and a second elongated segment, the first elongated segment positioned substantially perpendicular to the second elongated segment, the second elongated segment positioned adjacent to the integral portion of the clasp, the second elongated segment bendable about the integral portion enabling the first elongated segment to be disposed through the aperture for securing the first and second latching members together.

13. The latching holder according to claim 12, wherein:

a portion of each of the plurality of fasteners extendable through the first and second side walls of the support member;

the plurality of fasteners positionable in one of the first and second panels; and the other of the first and second panels contactable with the portion of the plurality of fasteners extending through the first and second side walls for securely holding the plurality of fasteners between the folded first and second panels.

14. The latching holder according to claim 12, further comprising at least one label attached to the support member.

15. The latching holder according to claim 14, wherein the at least one label includes at least one aperture for disposition of the plurality of fasteners, and is color coded for providing information to a user of the latching holder.

* * * * *